United States Patent [19]

Cloud

[11] 4,362,073

[45] Dec. 7, 1982

[54] REVERSIBLE WRENCH

[75] Inventor: Don L. Cloud, Springfield, Mo.

[73] Assignee: L. C. Tool Distributors, Inc., Springfield, Mo.

[21] Appl. No.: 193,303

[22] Filed: Oct. 2, 1980

[51] Int. Cl.[3] ..... B25B 13/00

[52] U.S. Cl. ..... 81/59.1

[58] Field of Search ..... 81/54.1; 192/45.1, 44

[56] References Cited

U.S. PATENT DOCUMENTS

| | | | |
|---|---|---|---|
| 564,250 | 7/1896 | Knowlton . | |
| 1,655,865 | 1/1928 | Hooper | 81/59.1 |
| 1,859,600 | 5/1932 | Rettyman . | |
| 1,904,621 | 4/1933 | Kounovsky | 81/59.1 |
| 2,119,622 | 6/1938 | Freber | 81/59.1 |
| 2,584,256 | 2/1952 | Brown | 81/59.1 |
| 2,722,149 | 11/1955 | Henley | 81/59.1 |
| 2,860,750 | 11/1958 | Avanzadi | 192/44 |
| 3,621,739 | 11/1971 | Seablom | 192/44 |
| 3,823,625 | 7/1974 | Myers | 192/44 |
| 4,051,935 | 10/1977 | Nakayama | 81/59.1 |

*Primary Examiner*—James L. Jones, Jr.

*Attorney, Agent, or Firm*—Stevens, Davis, Miller & Mosher

[57] ABSTRACT

A reversible ratchetless wrench having a base which extends from the wrench handle, through which extends an aperture in which a post is retained. The shape of the apparatus is such that the base is at least partially spaced from the post. Torque transmission cylinders are movably located between the post and the base in the aperture, and are capable of contacting both simultaneously. A reversing hub is non-elastically connected to the torque transmission cylinders and can move the cylinders to allow reversing of the wrench.

5 Claims, 4 Drawing Figures

REVERSIBLE WRENCH

BACKGROUND OF THE INVENTION

1. Field of the Invention

This invention relates to reversible tools, and more particularly to a reversible, ratchetless socket wrench.

2. Description of the Prior Art

Prior reversible wrenches have been complicated and often involved pawl and ratchet or complex spring systems. They have been sensitive to environmental impurities such as dirt and grime, which are often encountered in everyday use. These relatively complicated devices have often been subject to increased wear with parts difficult to replace. These devices have also often required a relatively large amount of open space for operation.

SUMMARY OF THE INVENTION

It is an object of this invention to provide a long-wearing reversible wrench.

It is a further object of this invention to provide a reversible wrench which is not overly sensitive to environmental impurities.

It is a still further object of this invention to provide a reversible wrench of simple and economical manufacture.

The above objects and others are obtained by providing a wrench with a base which extends from one end of the wrench handle. An aperture extends through the base, and a post is retained in the aperture. The base is at least partially spaced from the post. Torque transmission members are movably located between the post and base and are non-elastically secured to a reversing hub located outside the base. A locking system is provided to releasably secure the reversing hub in one of two positions. The wrench requires minimal reverse rotation before a second forward rotation, and thus requires very little open space for operation.

DESCRIPTION OF A PREFERRED EMBODIMENT

Figure 1:
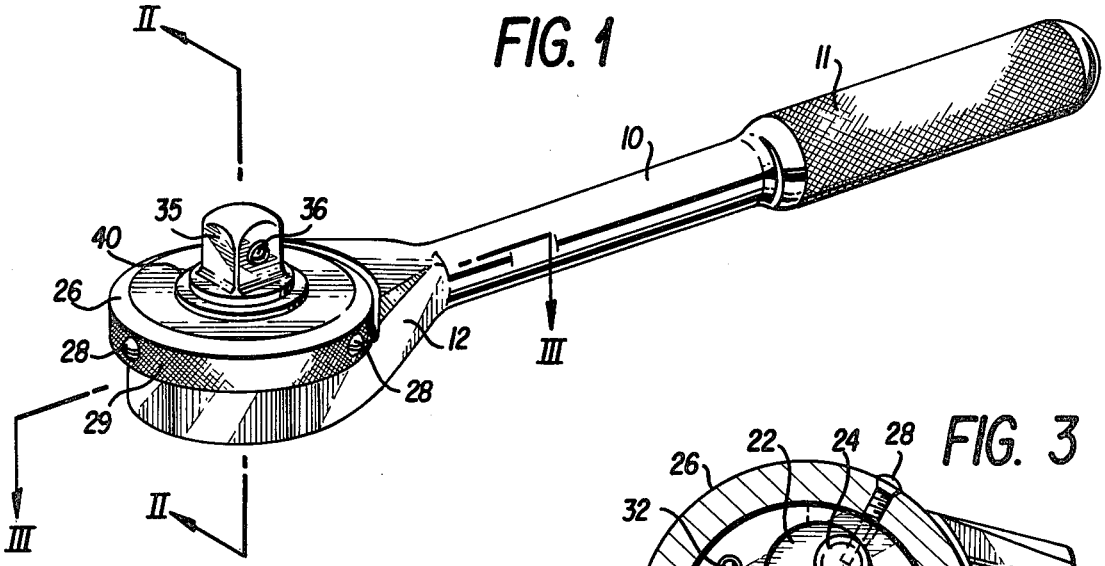
FIG. 1 shows a perspective view of the wrench of the present invention.

Referring to the drawings, a wrench is provided with a handle 10 having a grip aiding surface 11. Base 12, preferably having a lower section 14 and an upper section 16, extends from one end of the handle. Aperture 20 extends through the base. Post 18 with flange 19 fits in the aperture. Aperture 20 is shaped so that post 18 fits snugly but rotatably in the lower section 14 of the base 12 and is at least partially spaced from the upper section 16 of the base. Preferably, the shape of the aperture in the upper section of the base is defined by a plurality of interconnected part-cylinders 22.

Torque transmission cylinders 24 are movably located in aperture 20, between post 18 and the side of the upper section 16 of the base. Cylinders have been chosen to provide a good load bearing surface and simple manufacture, although other configurations would also give satisfactory results. Preferably, one cylinder 24 is provided in each part-cylinder 22. The cylinders must be capable of simultaneously contacting the post 18 and the upper section 16 of the base. A reversing hub 26, optionally provided with a grip aiding surface 29, is nonelastically connected to the cylinders 24. The preferred method of connection involves providing threaded holes 27 in the side of the hub 26, slots 30 in the side of the upper section 16 of the base, and hole 31 in the side of the cylinders 24. A connector, preferably a "dog-point" screw 28 is screwed into the threaded hole 27, passes through slot 30 and into hole 31 in the cylinder.

Figure 4:
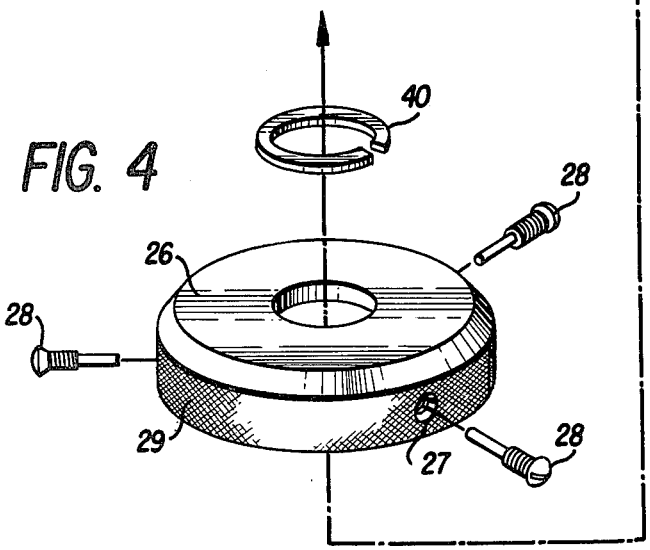
FIG. 4 shows an exploded view of part of the wrench of the present invention.
Figure 4:
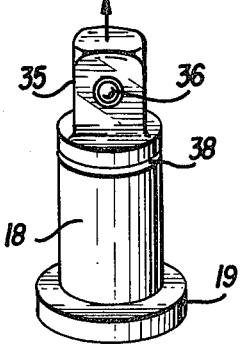

As can be seen in FIG. 4, hole 31 is preferably beveled on its outer periphery, and should be of slightly larger diameter than the "dog-point" portion of the screw. Of course, the hole must extend inwardly far enough to accommodate the screw. This allows for lateral-curvature movement of the screw 28.

The position of the reversing hub 26 can be secured by use of spring-loaded compression balls 32, which are permanently crimp mounted, placed on the upper surface of the upper section 16, which cooperate with recesses 34 in the upper interior of the reversing hub 26. Two recesses are provided for each compression ball. The arc circumscribed by each pair of recesses is equal to that circumscribed by the maximum movement of each center of the cylinders 24. Preferably, the recesses have diameters twice those of the compression balls, and have depths equal to the projected height extension of the compression balls 32 above upper section 16. The recesses preferably have a conical shape so that the reversing hub 26 will seek center in a self-imposed twisting motion, thus spring-loading the cylinders 24.

A socket retainer made up of a head 35 and compression ball 36, as is well known in the art, is provided on the end of the post 18. The post 18 is preferably retained in the aperture 20 by means of a retention ring 40, which cooperates with groove 38, which is located on the post so as to be just outside the reversing hub 26 when the post is in aperture 20. Flange 19 also aids in the retention of the post in the aperture.

Figure 3:
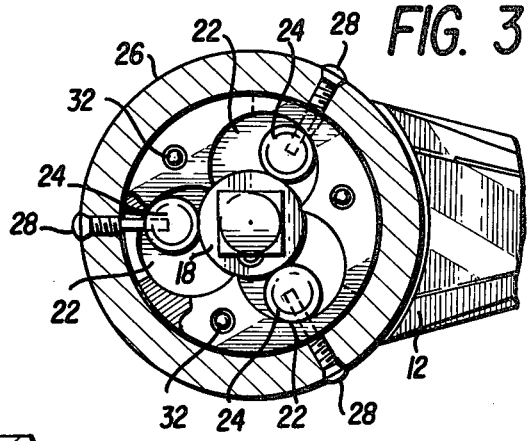
FIG. 3 shows a sectional top view taken along line III—III of FIG. 1.
Figure 2:
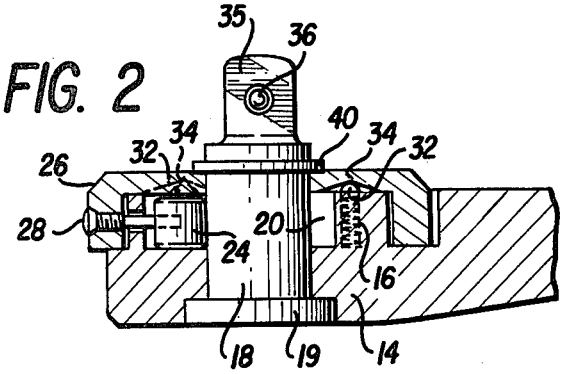
FIG. 2 shows a sectional side view taken along line II—II of FIG. 1.
Figure 2:
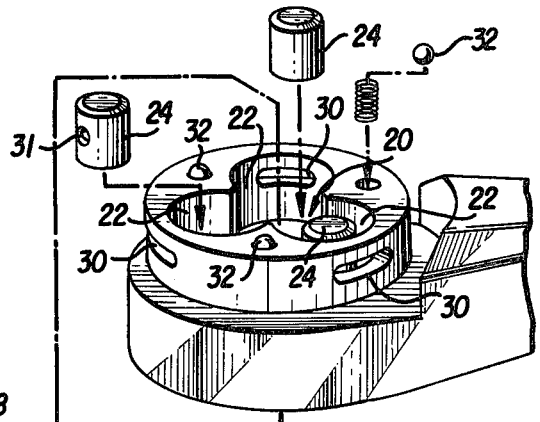

The operation of the wrench will now be described. Cylinders 24 provide torque transmission between the base 12 (connected to the handle 10) and post 18 (connected to a socket). Referring to FIG. 3, upon counterclockwise rotation of the wrench, the cylinders 24 are tightly wedged between the upper section 16 of the base and post 18, frictionally transmitting torque to the post. Upon clockwise rotation of the wrench, cylinders 24 are not wedged, and the base slips by the cylinders without rotation of the post 18. Thus, minimum reverse rotation of the wrench is required to allow a second forward rotation of the wrench. No back play at all is required to cock the tool as is required in conventional pawl and ratchet tools.

If the reversing hub 26 is rotated counterclockwise, cylinders 24 are moved into contact with the post 18 and the upper section 16 of the base on the opposite sides of the part-cylinders 22. Thus, upon clockwise rotation of the wrench, cylinders 24 become tightly wedged and transmit torque, while allowing free rotation upon counterclockwise rotation of the wrench. The positioning of the compression balls 30 and recesses 34 should be such that the compression balls and recesses cooperate at the furthest extents of movement of the cylinders 24, providing a signal that the wrench is in one or the other operating position. Although a cylindrical post, torque transmission cylinders, compression ball locking means, and a reversing hub with dog point screws are described and are the preferred embodiment, other configurations and forms could be satisfactorily used without materially departing from the scope and spirit of this invention.

What is claimed is:

1. A wrench, comprising:

handle means having two ends;

a base having an upper section and a lower section extending from one end of said handle means;

an aperture through said base;

a generally cylindrical post having upper and lower ends, having a flange at the lower end thereof, extending through said aperture, said aperture being shaped so that said post fits snugly in the lower section of said base and the upper section of said base is spaced from said post, said aperture being defined in the upper section of said base by a plurality of interconnecting part-cylinders;

socket retaining means attached to the upper end of said post located outside base when said post is in said aperture;

retention means for retaining said post in said aperture;

generally cylindrical torque transmission means of radius less than that of said part-cylinders movably located in said aperture in the upper section of said base, having a height less than or equal to the vertical thickness of the upper section of said base, said torque transmission means having a generally horizontally extending hole;

said base further comprising horizontal slots in the upper section of said base;

reversing means comprising a reversing hub located around and above the upper section of said base, having a hole located radially outwardly of one of said cylindrical torque transmission means;

non-elastic connecting means securing said hub to said torque transmission means by extending through said hole in said hub through said slot into said hole in said torque transmission means; and locking means for releasably retaining said reversing means.

2. A wrench, comprising:

handle means having two ends;

a base extending from one end of said handle means having an upper section and a lower section;

an aperture through said base;

a generally cylindrical post having upper and lower ends, having a flange at the lower end thereof, extending through said aperture, said aperture being shaped so that said post fits snugly into the lower section of said base and to the upper section of said base is spaced from said post, said aperture being defined in the upper section of said base by a plurality of interconnecting part-cylinders;

socket retaining means attached to the upper end of said post located outside said base when said post is in said aperture;

retention means for retaining said post in said aperture;

generally cylindrical torque transmission means of radius less than that of said part-cylinders movably located in said aperture in the upper section of said base, having a height less than or equal to the vertical thickness of the upper section of said base, having a generally horizontal hole;

the upper section of said base having an upper surface and generally horizontal slots extending through its sides;

reversing means comprising a reversing hub having an interior face, located around and above said upper section of said base, having a threaded hole located radially outwardly of said cylindrical torque transmission means;

a screw extending through said threaded hole, through said slot, and into the hole in said torque transmission means, non-elastically securing said torque transmission means to said reversing hub; and locking means for releasably retaining said reversing hub, comprising a compression ball in the upper surface of said upper section and two recesses into the interior of said reversing hub cooperating with said ball bearing, said recesses circumscribing an arc equal to the maximum arc circumscribed by the center of said torque transmission means when said torque transmission means is moved.

3. A wrench as claimed in claim 2 wherein said screw is a dog-point screw.

4. A wrench as claimed in any one of claims 1 or 2 wherein said post has a substantially horizontal and circumferential groove located immediately outside said base when said post is in said aperture, and said retention means comprises a retention ring fitting in said groove.

5. A wrench as claimed in any one of claims 1 or 2 wherein said socket retaining means comprises a compression ball.

* * * * *